US006956526B1

(12) United States Patent
Lundstedt, Jr. et al.

(10) Patent No.: US 6,956,526 B1
(45) Date of Patent: Oct. 18, 2005

(54) METHOD AND APPARATUS FOR SATELLITE ANTENNA POINTING

(75) Inventors: Jack Lundstedt, Jr., Monrovia, MD (US); John Schmid, Gaithersburg, MD (US); Richard Sims, Walkersville, MD (US); Peter Hou, Germantown, MD (US); Patrick Marrone, Harpers Ferry, WV (US); Lawrence Cronise, Spencerville, MD (US)

(73) Assignee: The DIRECTV Group Inc., El Segundo, CA (US)

( * ) Notice: Subject to any disclaimer, the term of this patent is extended or adjusted under 35 U.S.C. 154(b) by 0 days.

(21) Appl. No.: 10/967,416

(22) Filed: Oct. 18, 2004

(51) Int. Cl.[7] ..... H01Q 3/00
(52) U.S. Cl. ..... 342/359
(58) Field of Search ..... 342/74, 75, 359; 343/754, 757, 761

(56) References Cited

U.S. PATENT DOCUMENTS 5,296,862 A * 3/1994 Rodeffer et al. ..... 342/359
5,515,058 A * 5/1996 Chaney et al. ..... 342/359
5,561,433 A * 10/1996 Chaney et al. ..... 342/359
5,583,514 A * 12/1996 Fulop ..... 342/359
5,760,739 A * 6/1998 Pauli ..... 342/359
6,697,026 B1 * 2/2004 Hemmingsen, II ..... 343/760
2002/0018016 A1 * 2/2002 Radonic ..... 342/359

* cited by examiner

*Primary Examiner*—Dao Phan
(74) *Attorney, Agent, or Firm*—Craig Plastrik

(57) ABSTRACT

A method of pointing an antenna at a transmitter comprising the steps of: (a) varying the azimuth of the antenna dish a predetermined number of degrees in a first direction from a predetermined azimuth angle; (b) measuring a first signal strength of an incoming signal received by the antenna dish; (c) varying the azimuth of the antenna dish the same predetermined number of degrees in a second direction from the predetermined azimuth angle, where the second direction is opposite to the first direction; (d) measuring a second signal strength of the incoming signal received by the antenna dish; and (e) comparing the first signal strength to the second signal strength, and if the first signal strength substantially equals the second signal strength, the current predetermined azimuth angle represents the optimal angle of azimuth for the antenna dish. However, if the first signal strength does not substantially equal the second signal strength, the process further comprises the steps of: (f) adjusting the predetermined azimuth angle, and (g) repeating steps (a)–(e). The same process is then repeated for the elevation adjustment.

32 Claims, 7 Drawing Sheets

METHOD AND APPARATUS FOR SATELLITE ANTENNA POINTING

BACKGROUND OF THE INVENTION

1. Field of the Invention

The present invention relates to a method and apparatus which allows an installer to quickly and accurately point, and fine tune the pointing of an antenna, without the need of utilizing expensive monitoring equipment.

2. Description of the Related Art

Conventional methods of pointing a satellite antenna dish to optimally transmit and receive signals from a geo-synchronous satellite involve mounting the antenna on the intended platform, pointing the antenna in the general direction of the satellite, monitoring the signal strength of the signal received by the antenna (which is transmitted by the satellite) and varying the direction of the antenna in an effort to maximize the strength of the received signal. The position of the antenna which results in maximum received signal strength is selected as the permanent position. This technique is known, as "peaking" the signal.

In one example of performing this technique, the ground terminal (also referred to as the satellite terminal or "ST"), which is located at a remote location and includes the antenna to be aligned, is provided with the capability of generating a voltage signal having a level indicative of the strength of the signal received by the antenna. Typically, the voltage signal is a DC signal and can be measured utilizing a voltmeter or other signal strength indicator. Accordingly, when utilizing the foregoing alignment technique, the operator monitors the strength of the voltage signal, while adjusting the direction of the antenna and selects the position of the antenna corresponding to the highest obtainable level of the voltage signal as measured by the voltmeter. It is noted that in existing satellite receiver/transmitter systems, the value of the signal strength of the voltage signal rises as the antenna is pointed toward the satellite source and falls as it is moved away from the satellite source. Of course, the opposite is also possible.

While the foregoing method allows for the antenna installer to quickly point the antenna in the general direction of the desired satellite, it does not allow the antenna operator to fine tune the pointing of the antenna. In other words, the antenna installer cannot confirm that the maximum possible signal has been received. Indeed, the antenna installer simply adjusts the antenna position until a predetermined acceptable signal strength is received. However, the installer has no means of confirming whether or not this is the maximum possible signal available. This is due to the fact that the directivity of the antenna is relatively flat in the area defining the peak of the antenna pattern. As such, it is difficult to discern the pointing error (i.e., the shift from actual peak). It is noted that while it would be possible for the installer to confirm receipt of the maximum signal strength if the installer was provided sophisticated signal analysis equipment, such as a spectrum analyzer, it is not possible to do so as the costs of providing such equipment to the operator are prohibitive.

Accordingly, there remains a need for an apparatus that allows an antenna operator to quickly and easily determine whether the antenna has been positioned so as to achieve optimum signal strength of the received signal transmitted by the satellite, without the need for the operator to have access to sophisticated signal analysis equipment. It is further noted that the existing antenna pointing techniques are not likely to achieve the stringent antenna pointing requirements/tolerances (e.g., <0.2 degrees) that can be required for successful operation of broadband, multimedia satellite communication systems with terminals employing a receiving antenna having a reduced diameter (i.e., a small antenna). This is especially true given the fact that typical satellite systems uplink at higher frequencies with narrower beam widths, thus pointing errors measured by the receiver are amplified in the transmit direction.

SUMMARY OF THE INVENTION

The present invention relates to the method and apparatus for providing a simple, cost effective method and apparatus for allowing a sole installer to quickly and accurately point an antenna so as to optimally transmit and receive signals from a satellite. More specifically, the present invention allows the operator to quickly identify the position of the antenna necessary for maximizing the strength of the incoming (i.e., received) signal from a satellite.

In an exemplary embodiment, the apparatus in accordance with the present invention comprises an antenna dish; an elevation misalignment member coupled to the antenna dish and operative for varying an elevation angle of the antenna dish. The elevation misalignment member is capable of precisely setting the elevation angle in a first misalignment position and a second misalignment position, where the first misalignment position and the second misalignment position represent the same degree of change of elevation from a set elevation angle, and where the first misalignment position and the second misalignment position are in opposite directions from one another. Similarly, the apparatus also comprises an azimuth misalignment member coupled to the antenna dish and operative for varying an azimuth angle of the antenna dish. The azimuth misalignment member is also capable of precisely setting the azimuth angle in a first misalignment position and a second misalignment position, where the first misalignment position and the second misalignment position represent the same degree of change of azimuth from a set azimuth angle, and where the first misalignment position and the second misalignment position are in opposite directions from one another.

The present invention also relates to a method of pointing an antenna at a transmitter, which is referred to herein as the dither pointing method. In an exemplary embodiment, the method comprises the steps of: (a) varying the azimuth of the antenna dish a predetermined number of degrees in a first direction from a predetermined azimuth angle; (b) measuring a first signal strength of an incoming signal received by the antenna dish; (c) varying the azimuth of the antenna dish the same predetermined number of degrees in a second direction from the predetermined azimuth angle, where the second direction is opposite to the first direction; (d) measuring a second signal strength of the incoming signal received by the antenna dish; and (e) comparing the first signal strength to the second signal strength, and if the first signal strength equals the second signal strength, the current predetermined azimuth angle represents the optimal angle of azimuth for the antenna dish. However, if the first signal strength does not equal the second signal strength, the process further comprises the steps of: (f) adjusting the predetermined azimuth angle, and (g) repeating steps (a)–(e). The same process is then repeated for elevation adjustment. It is noted that while in the preferred embodiment the antenna is adjusted first in azimuth and then in elevation, it is also possible to adjust the antenna first in elevation and then in azimuth.

As described below, the method and apparatus for pointing an antenna in accordance with the present invention provides important advantages over the prior art. Most importantly, the present invention provides a low cost means for allowing a sole operator to quickly and easily fine tune the pointing of an antenna so as to maximize the strength of an incoming signal being transmitted by a satellite.

In addition, the method and apparatus of the present invention does not require the installer to be provided with expensive signal analysis equipment, such as a spectrum analyzer, in order to accurately point the antenna.

Yet another advantage is that because the present invention allows for precise alignment of the antenna and substantially eliminates antenna pointing error, the amount of power necessary for achieving acceptable communications between the satellite and the remote terminal coupled to the antenna is reduced. Among other things, this reduction in the power requirement reduces costs, improves overall G/T (i.e., gain/temperature) performance and advantageously reduces the amount of adjacent satellite interference and co-satellite crosspol interference.

The invention itself, together with further objects and attendant advantages, will best be understood by reference to the following detailed description, taken in conjunction with the accompanying drawings.

DETAILED DESCRIPTION OF THE DRAWINGS

Figure 1:
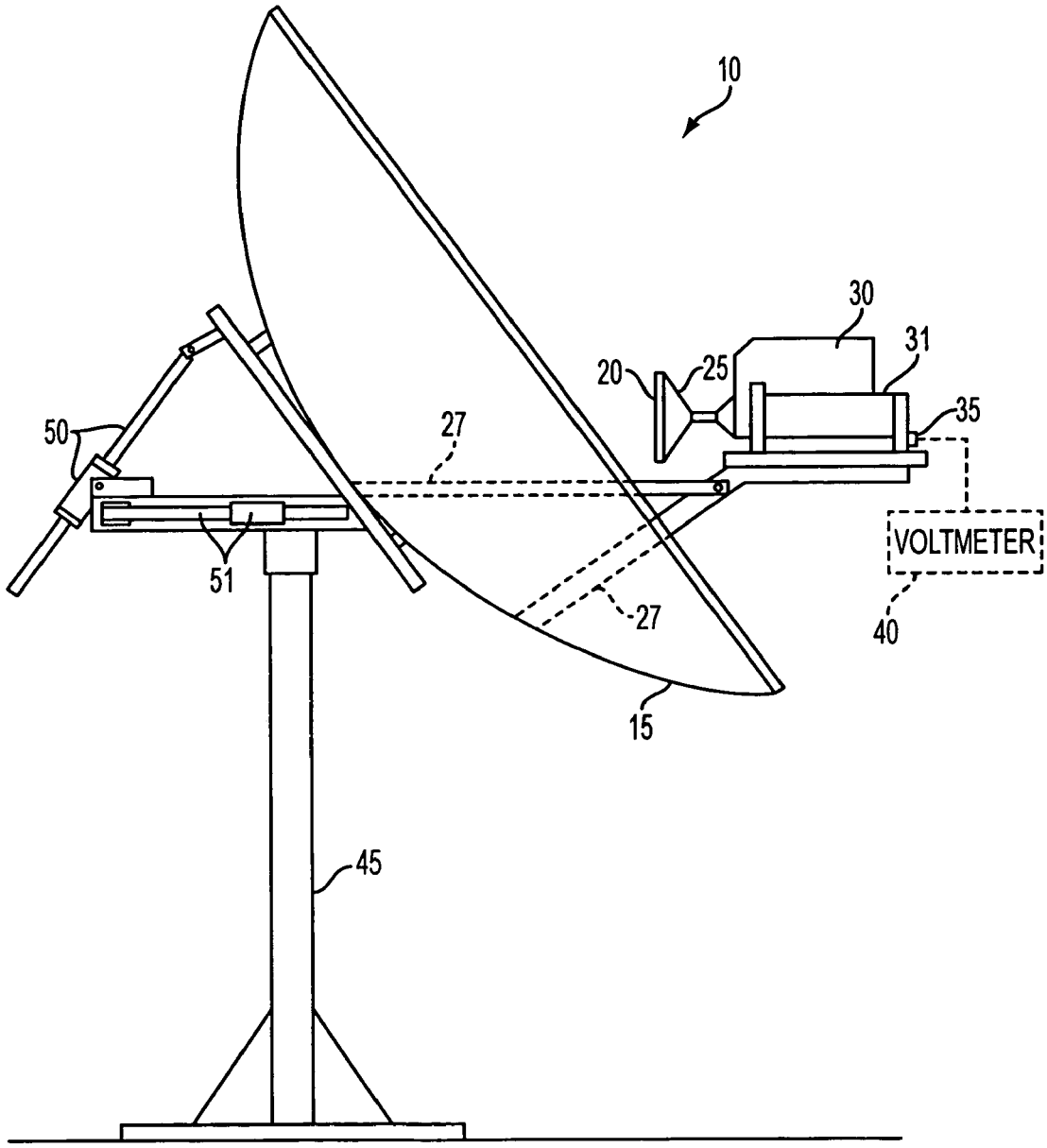
FIG. 1 is a side view of a satellite receiver antenna dish comprising an exemplary embodiment of the present invention.

FIG. 1 is a side view of a satellite receiver antenna assembly 10, which incorporates an exemplary embodiment of the antenna pointing device of the present invention. Referring to FIG. 1, the antenna assembly comprises a dish 15 that is utilized to both reflect and focus electromagnetic signals received from a geo-synchronous satellite (not shown) into an opening of a feed horn 25, as well as transmit signals to the satellite. The dish 15 can be any of a number of shapes, such as circular, elliptical or rectangular. The dish 15 shown in FIG. 1 is circular for illustrative purposes. It is further noted that while the examples disclosed herein describe aligning the antenna with a geo-synchronous satellite, the antenna pointing device and method of the present invention can be utilized with essentially any antenna pointing application.

Referring again to FIG. 1, the signals provided to the feed horn 25 are processed by a low noise block radio frequency detector 30. The feed horn 25 and the low noise block radio frequency converter 30 and the microwave power amplifier 31 are attached to the dish 15 via one or more struts 27. The microwave power amplifier 31 is also provided with one or more auxiliary electrical connectors. One of these electrical connectors 35 provides an output voltage or current that is proportional to the power and/or signal quality received by the opening of the feed horn 25 from the satellite. A measurement and/or computing device 40 such as a voltmeter can be electrically connected to the electrical connector 35. The measurement device provides either a digital or analog output signal indicating the signal strength of the incoming signal. More broadly, a representation of the signal strength can be provided via some appropriate auxiliary mechanism such as a pocket PC or palm device. As described in more detail below, the measurement device 40 will be utilized to facilitate the determination of the direction and angle that the antenna dish 15 should be pointed in order to achieve optimum signal strength from the satellite.

The antenna assembly 10 further comprises a mounting device or antenna stand 45, which is used to elevate the antenna dish 15, feed horn 25 and low noise block radio frequency detector 30, and microwave amplifier 31 above the ground. As explained in further detail below, the assembly 10 further comprises an elevation movement mechanism 50, which functions to attach the antenna stand 45 to the antenna dish 15, and which provides for movement of the antenna dish 15 in the north/south direction (i.e., elevation). The assembly 10 also comprises an azimuth movement mechanism 51, which also functions to attach the antenna stand 45 to the antenna dish 15 and which provides for movement of the antenna dish in the east/west direction (i.e., azimuth). It is noted that in the preferred embodiment, the elevation movement mechanism 50 moves the antenna dish 15 in a direction which is orthogonal to the direction of movement provided by the azimuth movement mechanism 51. The elements forming both the elevation movement mechanism 50 and the azimuth movement mechanism 51 are described in detail below.

When initially aligning the antenna to the desired satellite, the antenna is first pointed in the general direction of the desired satellite. The directional coordinates (i.e., azimuth and elevation) of the antenna necessary for the antenna to point at the desired satellite are known by the installer, and are utilized to initially point the antenna at the satellite. Once the antenna is positioned to the directional coordinates of the desired satellite, the antenna is quickly swept in the azimuth and elevation directions until the antenna is pointed sufficiently accurately that it can begin receiving a signal from the satellite. As such, at this time the measurement device 40 will output a signal indicating the signal strength of the received signal. Typically, there is a predetermined value of received signal strength that indicates that the antenna dish 15 is pointed in the general vicinity of the location that would provide the maximum signal strength. The installer will adjust the antenna in either elevation and/or azimuth until the received signal strength, as measured by the measurement device, exceeds this predetermined value. This process is generally referred to as coarse pointing of the antenna.

Once the antenna is coarse pointed, as stated above, the antenna dish 15 is able to receive a signal from the transmitting satellite. The next step in the alignment process in accordance with the present invention is to fine tune the pointing direction of the antenna. In other words, position the antenna such that the peak of the antenna's receive signal pattern is pointed at the satellite.

Figure 2:
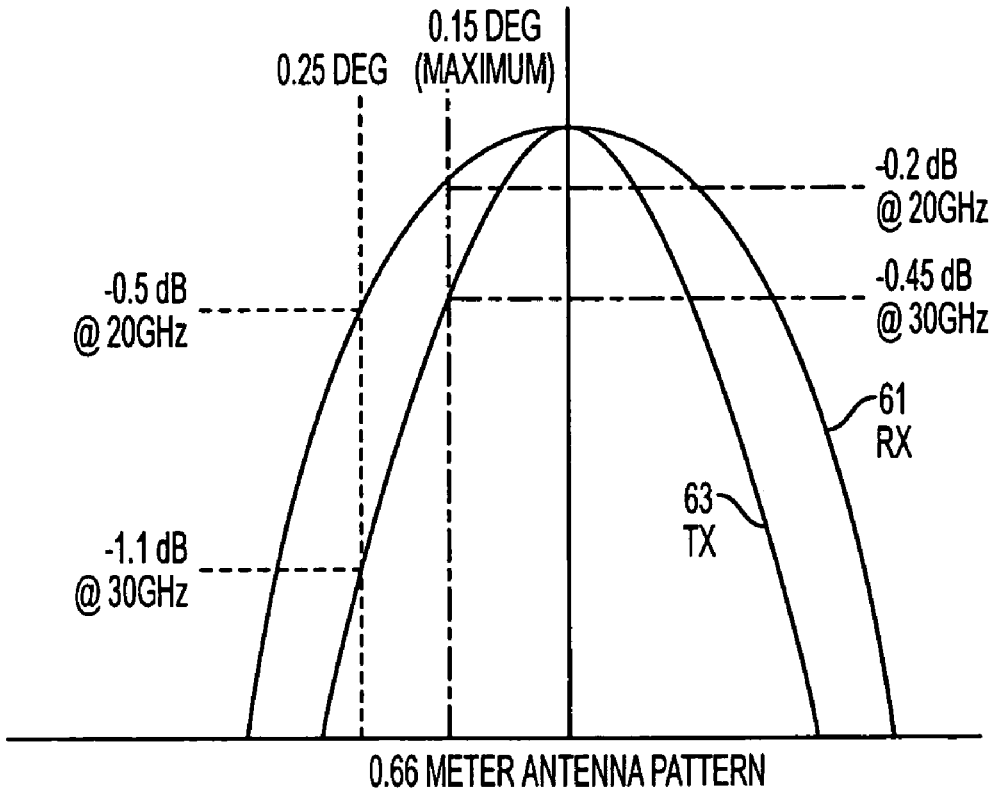
FIG. 2 illustrates an exemplary receive pattern and an exemplary transmit pattern for an antenna.

More specifically, referring to FIG. 2, which is an example of a receive pattern 61 and a transmit pattern 63 for a given antenna dish 15, during the fine tuning portion of the process, the objective is to point the antenna dish 15 such that the peak portion of the receive signal pattern 61 is aligned with the transmitter of the satellite. It is at this location that the antenna dish 15 will provide the maximum gain of the incoming signal, and therefore the peak also represents the location at which the satellite can output the least amount of power and still conduct proper communications with the remote terminal coupled to the antenna 15.

Figure 3A:
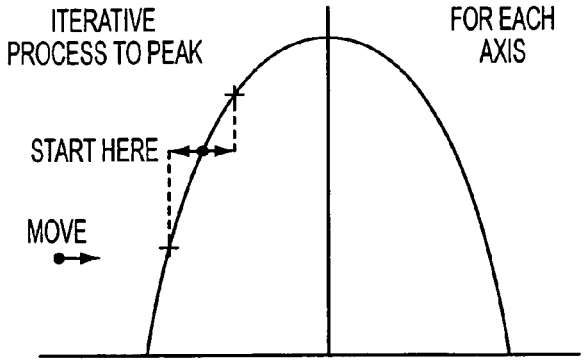
FIGS. 3*a*–3*d* provide a graphic illustration of the dithering process of the present invention.
Figure 3B:
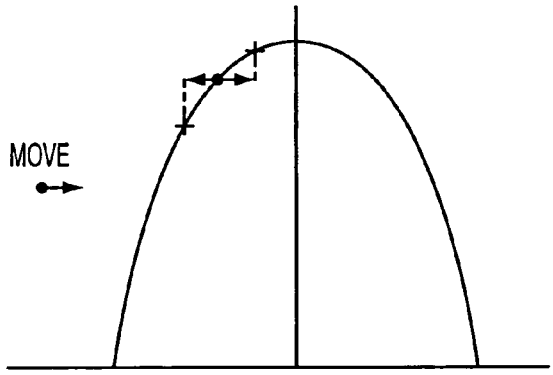
Figure 3C:
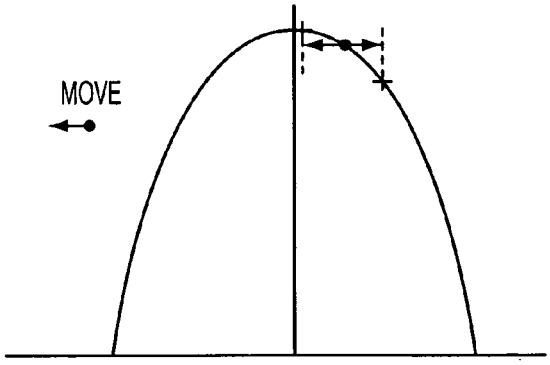
Figure 3D:
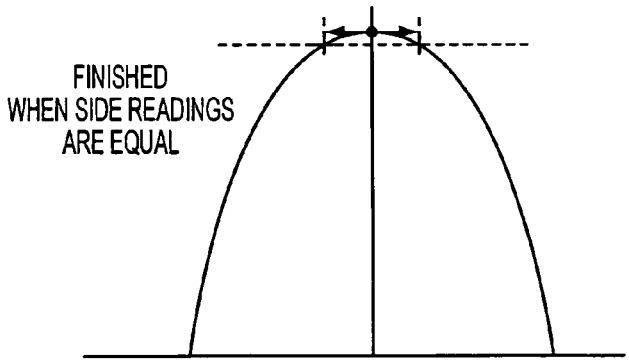

In accordance with the present invention, the process of fine tuning the antenna position comprises misaligning the antenna pointing direction symmetrically about the coarse pointing point in both elevation and azimuth, and recording the output of the measurement device at each misaligned location. It is important that the extent of the misalignment about the coarse pointing position is such that the directivity of the antenna receive pattern has a steep positive or negative slope at the misalignment positions. As graphically illustrated in FIGS. 3*a*–3*d*, and as explained in further detail below, as the elevation of the antenna is shifted about the coarse pointing position between the two misalignment positions, the only time the signal strength of the two misalignment positions are equal will be when the antenna is pointed at the peak position (see, e.g., FIG. 3*d*).

Specifically, at the peak position, if the antenna is lowered or raised in elevation by the same amount, the corresponding position on the antenna receive pattern will be the same, and therefore result in the same signal strength measurement. At any other position, if the antenna is lowered or raised in elevation by the same amount, the corresponding resulting positions on the antenna receive pattern will not be the same, and therefore will not result in the same signal strength measurement (see, e.g., FIGS. 3*a*–3*c*). Thus, in accordance with the present invention, the installer performs an iterative process of adjusting the position of the antenna until the signal strength at the first and second misalignment positions are substantially equal. This iterative process is performed for both elevation and azimuth. It is noted that the present invention requires that the antenna receive pattern 61 be substantially symmetric in azimuth and substantially symmetric in elevation.

Figure 4:
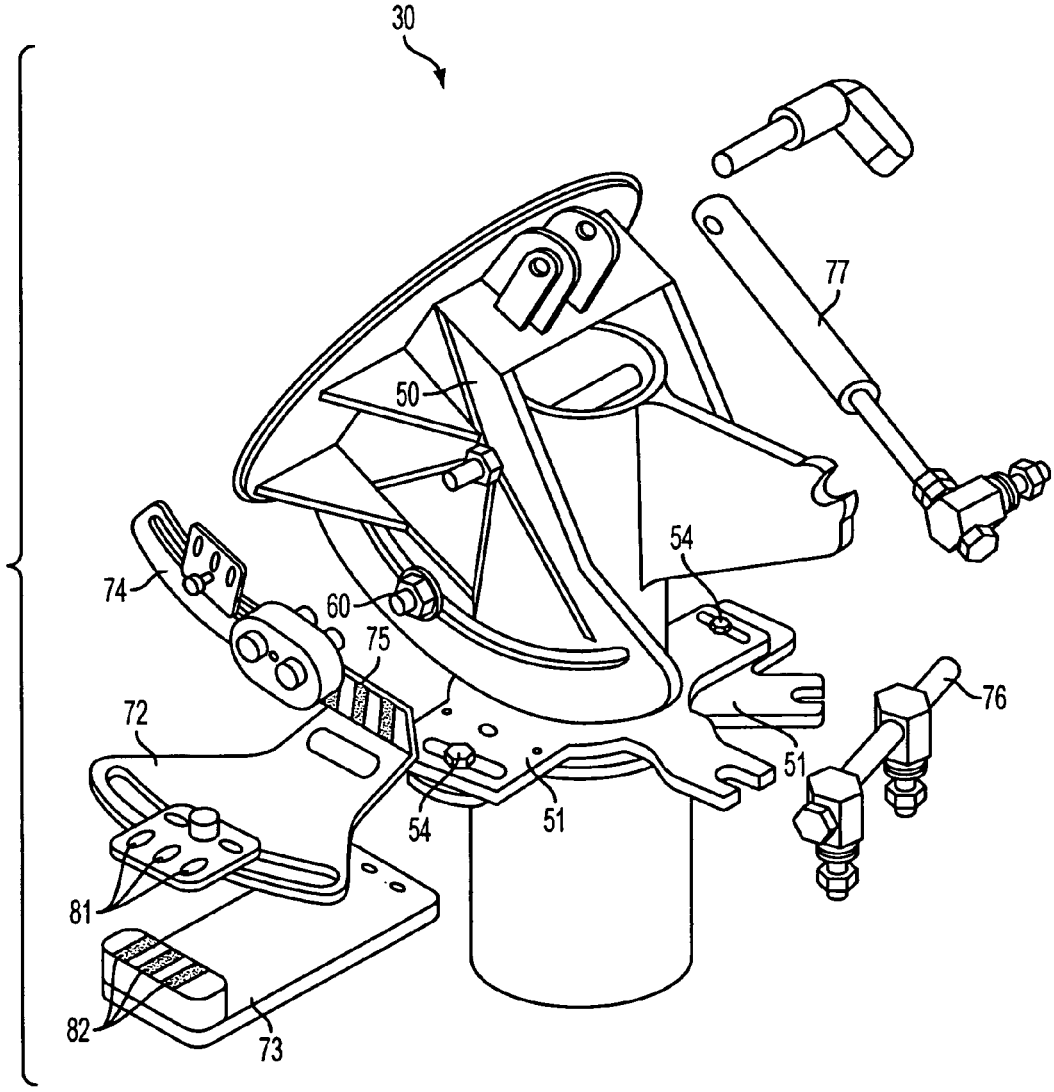
FIG. 4 is an exploded view of exemplary azimuth and elevation movement mechanisms and the azimuth and elevation dither indicator plates in accordance with the present invention.
Figure 5A:
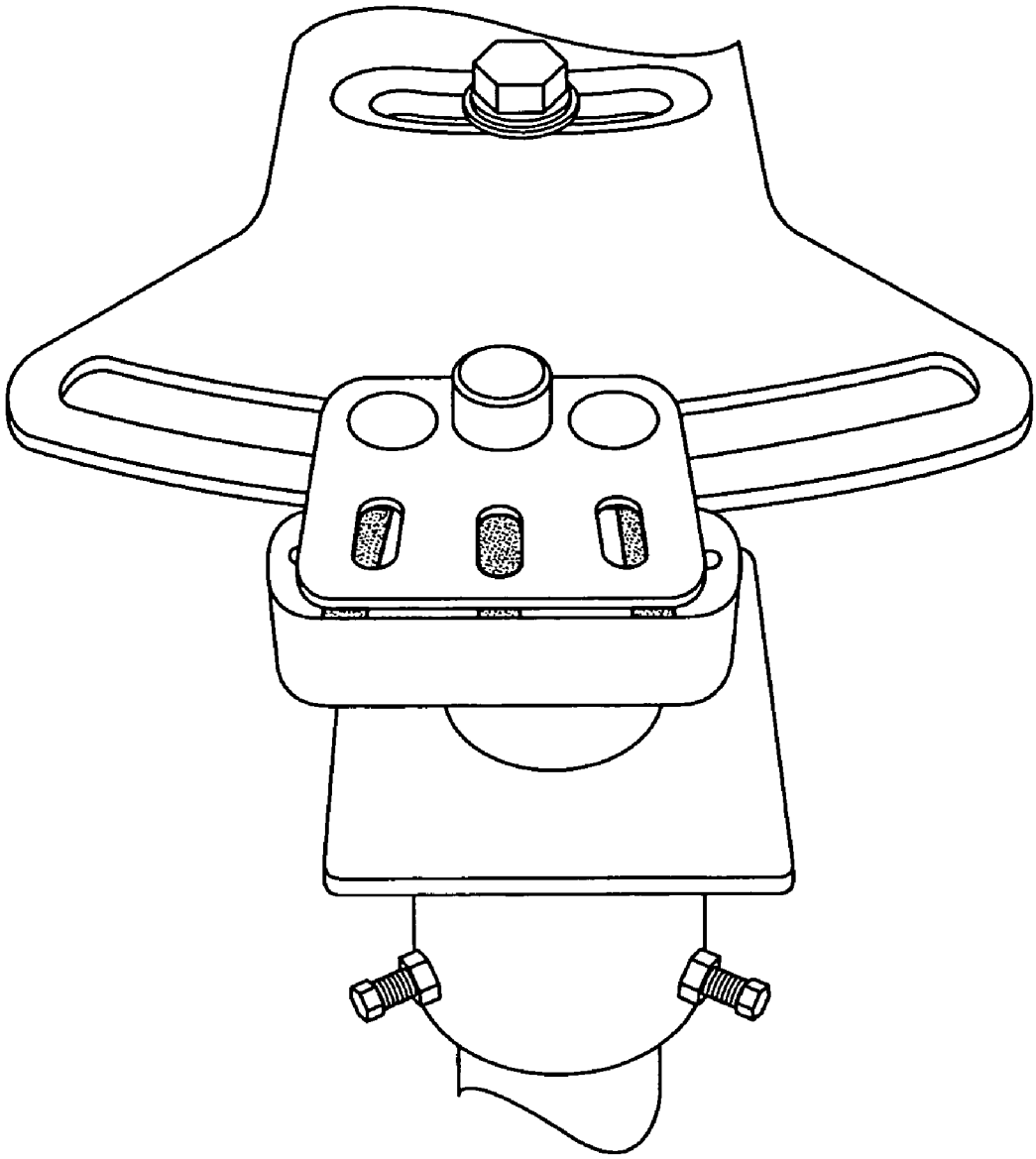
FIGS. 5*a*–5*c* illustrate the process of misaligning the antenna utilizing the dither plates of the present invention.
Figure 5B:
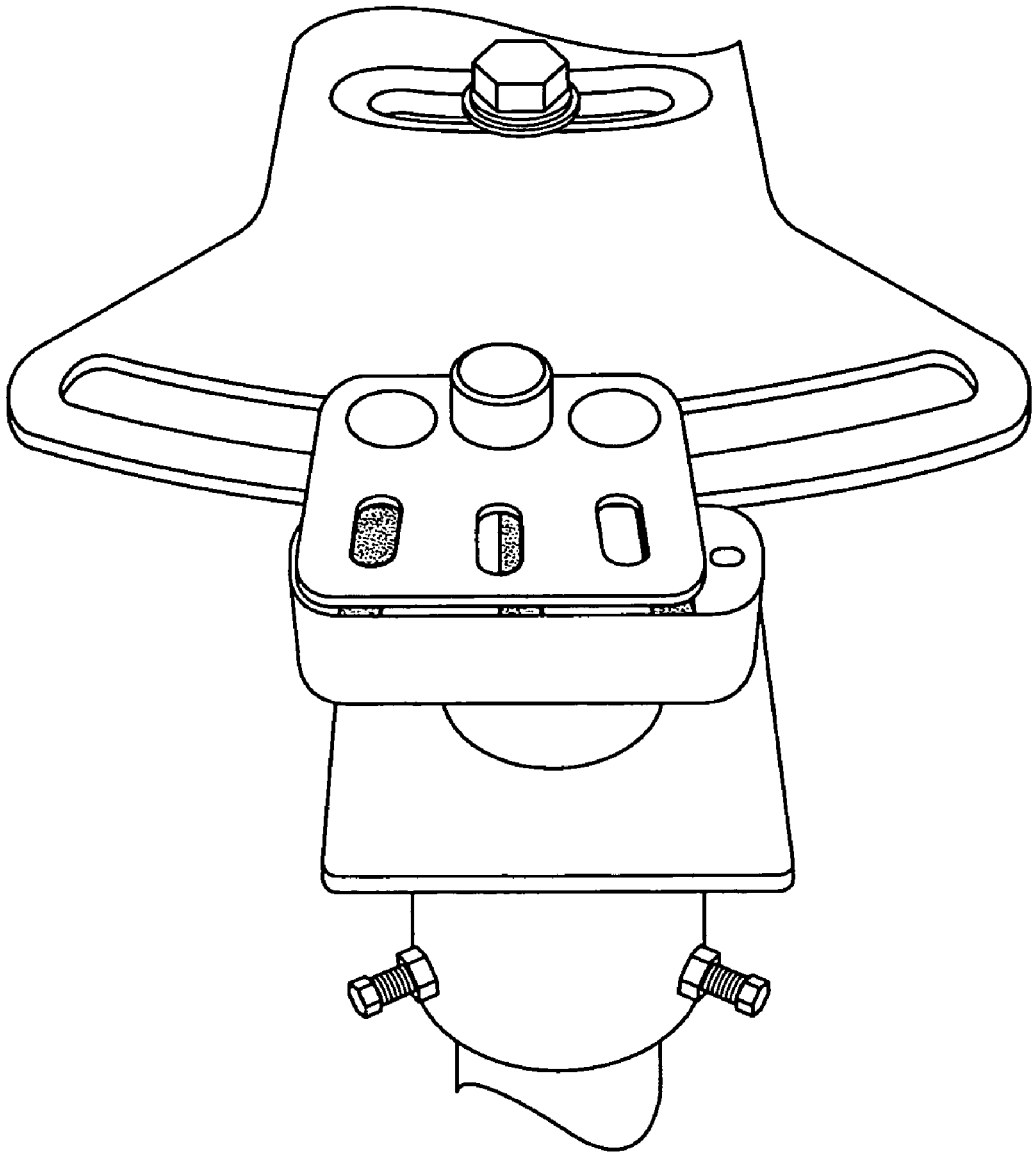
Figure 5C:
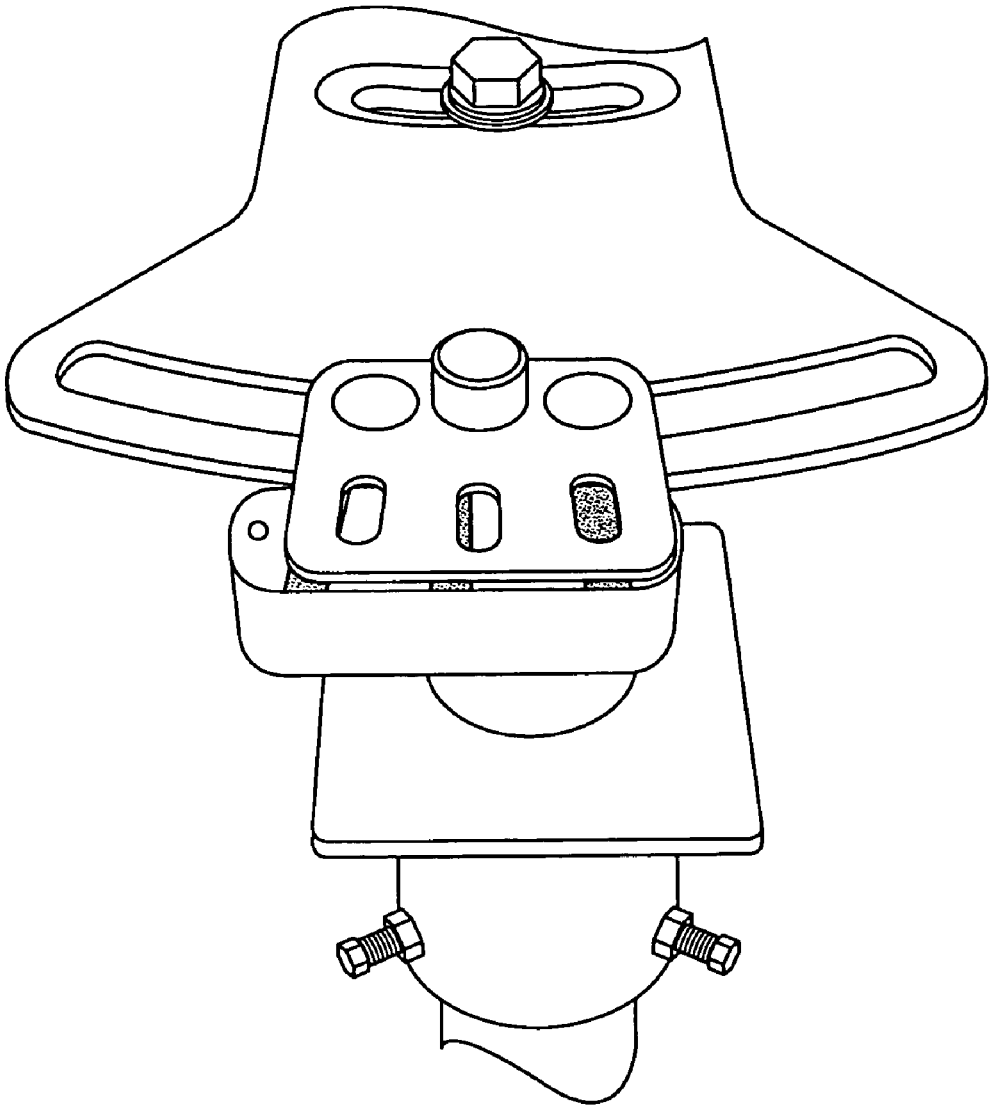

FIG. 4 is an exploded view of the azimuth and elevation movement mechanisms and the azimuth and elevation dither indicator plates (also referred to as misalignment members), which are utilized in the alignment process of the present invention. Referring to FIG. 4, the apparatus includes an azimuth movement mechanism 51 which allows the antenna to move in the east/west direction, and two azimuth lock-down bolts 54, which when tightened function to secure the antenna in position and prevent further rotation. The apparatus further includes an elevation movement mechanism 50 which allows the antenna to move in the north/south direction, and two elevation lock-down bolts 60, which when tightened also function to secure the antenna in position and prevent further rotation of the antenna. The apparatus also includes a first and second azimuth dither plate 72 and 73, and a first and second elevation dither plate 74 and 75. More specifically, the azimuth dither plates include an azimuth sliding window plate 72 and an azimuth indicator plate 73. Similarly, the elevation dither plates include an elevation sliding window plate 74 and an elevation indicator plate 75. As explained in detail below, the dither plates are utilized to offset the antenna in opposite directions a predetermined amount from a given point of reference. Finally, the apparatus also includes an azimuth adjustment mechanism 76 and an elevation adjustment mechanism 77, which are utilized to provide fine adjustments of the antenna during the alignment process. As with the dither plates, in the given embodiment, the azimuth adjustment mechanism 76 and the elevation adjustment mechanism 77 are removable from the antenna so that these alignment tools can be re-utilized to align different antennas.

As is noted above, in accordance with the preferred embodiment of the present invention, the azimuth and elevation adjustment mechanisms 76, 77 and the azimuth and elevation dither plates 72–75 are removable from the antenna so that these alignment tools can be re-utilized to align different antennas. However, it is also possible to practice the method of the present invention utilizing alignment tools which are permanently fixed to the antenna.

A more detailed description of the foregoing alignment process is now provided. First, once the coarse pointing position is determined, the azimuth and elevation adjustment mechanisms 76, 77 and the azimuth and elevation dither plates 72–75 are attached to the antenna if they were not mounted during the coarse pointing process. Further, if the azimuth lock-down bolt 54 was tightened following coarse pointing, it is now loosened for the dither process (i.e., alignment process) so as to allow the antenna to move so as to perform the dither process.

As shown in FIGS. 4 and 5*a*–5*c*, the azimuth sliding window plate 72 has three openings 81 disposed therein, where the outer openings are equally spaced from the center opening. The azimuth indicator plate 73 has three markings 82, wherein the outer markings are equally spaced from the center marking. When mounted on the antenna, the azimuth sliding window plate 72 overlays the azimuth indicator plate 73 as shown, for example, in FIGS. 5*a*–5*c*. The azimuth sliding window plate 72 and the azimuth indicator plate 73 are mounted to the antenna such that the azimuth sliding window plate 72 and the azimuth indicator plate 73 move relative to one another as the azimuth adjustment mechanism 76 is utilized to vary the azimuth position of the antenna.

When performing the dither process, first, the center opening 82 of the azimuth sliding window plate 72 is centered over the center dither reference line 81 on the azimuth indictor plate 73 (as shown in FIG. 4*a*) at a position which typically corresponds to the azimuth position that was identified during the initial course pointing process. The azimuth sliding window plate 72 is then locked into place. The antenna is then turned in the azimuth direction by turning the azimuth adjustment mechanism 76, thereby misaligning the antenna in a first direction. The antenna is moved a predetermined angular distance from the center reference line in a first azimuth direction (i.e., the antenna is turned x degrees to the left of the center reference line). In the given embodiment, the installer stops turning the antenna when an outer dither window 81 on the azimuth sliding window plate 72 is centered over the corresponding outer dither reference line 82 on the azimuth indicator plate 73 (i.e. the right dither window is centered over the right dither reference line as shown in FIG. 5). The alignment marks and windows on the dither plates are such that this ensures that the antenna is misaligned a precise amount from the center reference line. At this first misalignment position, the signal strength of the received signal is recorded utilizing the measurement device 40. Next, the antenna dish 15 is misaligned the same predetermined amount from the coarse pointing position in a second azimuth direction, which is opposite to the first direction (i.e., the antenna is turned x degrees to the right of the center reference line). In this case, the installer stops turning the antenna when the outer dither window 81 of the azimuth sliding window plate 72 is centered over the corresponding outer dither reference line 82 of the azimuth indicator plate 73 (i.e. the left dither window is centered over the left dither reference line as shown in FIG. 4*c*). At this second misalignment position, the received signal strength is again recorded utilizing the measurement device 40.

If the difference between the signal strength readings taken at the two misalignment positions is below a predetermined threshold, the antenna is considered sufficiently well pointed in the azimuth direction. The antenna is returned to the center reference line and the azimuth lock-down bolts 54 are tightened. It is noted that the predetermined threshold is application specific, and depends on the final pointing accuracy requirement, the antenna radiation pattern, the distance to the misalignment positions, and the effect of atmospheric scintillation on the received signal strength.

If, however, the difference between the signal strength readings taken at the two misalignment positions is greater than the predetermined threshold described above, then the antenna is considered misaligned in the azimuth direction, and further alignment is required. This further alignment process is as follows. First, the average of the signal strength readings taken at the two misalignment positions is computed. Then, the antenna is turned a small amount until the signal strength reported by the measurement device 40 is equal to the computed average. When this small adjustment is made to the antenna, the outer dither window on the azimuth sliding window plate 72 will move slightly off of the outer reference line 82 on the azimuth indicator plate 73. Next, the installer aligns the azimuth indicator plate 73 to the new reference line location (i.e., the position where the measured signal strength substantially equals the previously computed average) by unlocking the azimuth indicator plate 73, moving the plate such that the outer window is centered about the corresponding outer reference line, and locking the azimuth indicator plate 73 back down.

After re-centering the outer window, the installer repeats the foregoing process of moving the antenna to the two misalignment positions, recording the signal strengths at the misalignment positions, comparing the difference to the predetermined threshold, and repeating again if necessary. With each iteration, the difference in the two signal strength readings should decrease until the difference is less than the predetermined threshold, at which point the dither process is complete in the azimuth direction. When the dither process is complete in the azimuth direction, the antenna is returned to the center reference line and the azimuth lock-down bolts are tightened.

This same dither process is then repeated with respect to elevation angle utilizing the elevation sliding window plate 74 and the elevation indicator plate 75, and upon completion, the elevation lock-down bolts are tightened. When the antenna has been pointed in both the azimuth and elevation using the above dither method, and the lock-down bolts have been tightened, the azimuth and elevation movement mechanisms and the azimuth and elevation dither indicator plates may be removed by the installer.

It is noted that the necessary amount of misalignment from the coarse pointing position to practice the present invention varies from application to application, as well as from antenna to antenna. Indeed, one of the primary characteristics necessary for determining the amount of misalignment is the antenna receive pattern 61. As stated above, in the preferred embodiment, the amount of misalignment should be sufficient to position the incoming signal on a steep portion of the antenna pattern 61 or, in other words, away from the substantially flat portion of the pattern 61 located by the peak. At locations away from the peak, minor shifts in angle result in noticeable shifts in received signal strength. As a general rule, the misalignment amount should be sufficient to reach 3 dB down from the peak of the antenna receive pattern 61.

Note that the above process uses a visual indicator to determine the precise amount to misalign the antenna to the misalignment positions. However, clearly other methods can be utilized to determine the accurate misalignment angles. These other methods include mechanical, electrical, or alternative visual methods. In all cases the indicator components must be firmly attached to the moveable antenna and the stationary antenna mount stand 45 (pole). Any undesired movement of the indicator components will cause errors in the final pointing accuracy.

It has been noted that atmospheric scintillation will cause the received signal strength to vary. If the scintillation is strong enough it is possible that the signal strength readings taken at the two misalignment positions will rarely be within the predetermined threshold, even if the antenna is pointed with perfect accuracy at the satellite. It is also possible that with strong scintillation the signal strength readings taken at the two misalignment positions will be within the predetermined threshold, even when the antenna angle has an error greater than the desired pointing accuracy the installer is attempting to achieve. For these reasons, in order to negate the effects of scintillation, it is beneficial to signal process the instantaneous receive signal strength at the antenna prior to displaying it at the measurement device 40. One possible implementation of such signal processing would be the utilization of a low pass filter. In the design of such a low pass filter, there is a tradeoff between the dynamic range of the filtered scintillation (the amount of scintillation the installer will see on the measurement device 40) and the time required for the filtered signal strength to achieve a steady-state when the antenna is moved during the dither pointing process. Ideally, the filter would be designed to smooth the worst-case scintillation enough to ensure with high probability that the antenna is pointed to the desired accuracy when the difference between the signal strength readings taken at the two misalignment positions is less than the predetermined threshold. The time-response of the filter would be set such that when the installer moves the antenna the filtered signal strength achieves its steady-state value quickly enough so that the misalignment pointing process can proceed at an acceptable pace to the installer. Different amounts of filtering could be used during the coarse pointing and the dither pointing time periods. Of course, other signal processing techniques to negate the effects of scintillation can also be utilized, for example, a computer program which operated to average the readings of the output amplitude.

It is further noted that with regard to the misalignment members (i.e., dither plates), while one possible embodiment has been illustrated, the present invention in no manner whatsoever intended to be limited to the disclosed embodiment. Clearly variations and/or modifications of the foregoing design of the misalignment member are possible. Indeed, the important aspects are that the misalignment members allow for precise misalignment (i.e., the same amount of variation) about a given position, and that the precise misalignment is repeatable. In other words, with regard to elevation for example, the misalignment member allows for the antenna dish to be shifted down-ward a predetermined amount from a given elevation angle, and then shifted upward by the same predetermined amount from the same given elevation angle. The same requirements hold for the misalignment member utilized to vary the antenna's azimuth.

As stated above, the method and apparatus for pointing an antenna in accordance with the present invention provides important advantages over the prior art. Most importantly, the present invention provides a low cost means for allowing a sole operator to quickly and easily fine tune the pointing of an antenna so as to maximize the strength of an incoming signal being transmitted by a satellite.

In addition, the method and apparatus of the present invention does not require the installer to be provided with expensive signal analysis equipment, such as a spectrum analyzer, in order to accurately point the antenna.

Yet another advantage is that because the present invention allows for precise alignment of the antenna and substantially eliminates antenna pointing error, the amount of power necessary for achieving acceptable communications between the satellite and the remote terminal coupled to the antenna is reduced. Among other things, this reduction in the power requirement reduces costs, improves overall G/T (i.e., gain/temperature) performance and advantageously reduces the amount of adjacent satellite interference and co-satellite crosspol interference.

Variations of the embodiments of the present invention described above are also possible. For example, if the present invention is being utilized to align an antenna with a geo-synchronous satellite, it is possible to have only a single antenna misalignment member (as opposed to having an azimuth misalignment member and an elevation misalignment member). The sole misalignment member functions to misalign the antenna along the orbital arc of the satellite. More specifically, once the antenna is coarse tuned in the same manner as set forth above, the sole misalignment member would allow the antenna to be misaligned in equal amounts along the orbital arc, and the process detailed above of adjusting the alignment until the measured power level of the received signal was equal in both the first and second misalignment positions would be performed, thereby aligning the antenna to the satellite.

Of course, it should be understood that a wide range of other changes and modifications can be made to the preferred embodiment described above. It is therefore intended that the foregoing detailed description be regarded as illustrative rather than limiting and that it be understood that it is the following claims including all equivalents, which are intended to define the scope of the invention.

We claim:

1. An antenna comprising:

an antenna dish;

an azimuth misalignment member coupled to said antenna dish and operative for varying an azimuth angle of said antenna dish, said azimuth misalignment member capable of precisely setting the azimuth angle in a first misalignment position and a second misalignment position, said first misalignment position and said second misalignment position representing the same degree of change of azimuth from a set azimuth angle, said first misalignment position and said second misalignment position being in opposite directions from said set azimuth angle; and an elevation misalignment member coupled to said antenna dish and operative for varying an elevation angle of said antenna dish, said elevation misalignment member capable of precisely setting the elevation angle in a first misalignment position and a second misalignment position, said first misalignment position and said second misalignment position representing the same degree of change of elevation from a set elevation angle, said first misalignment position and said second misalignment position being in opposite directions from said set elevation angle.

2. The antenna of claim 1, further comprising:

a demodulation circuit for downconverting an incoming signal received by said antenna dish and producing an output signal having an amplitude that is proportional to the signal strength of the incoming signal; and a measurement apparatus coupled to said demodulation circuit and operative for producing an output indicative of the amplitude of the output signal of said demodulation circuit.

3. The antenna of claim 2, wherein said measurement apparatus comprises one of the group consisting of a voltmeter, a current meter, and portable computing device.

4. The antenna of claim 1, further comprising a measurement apparatus coupled to said antenna and operative for producing an output indicative of an amplitude of a signal received by said antenna dish.

5. The antenna of claim 4, wherein said measurement apparatus comprises one of the group consisting of a voltmeter, a current meter, and portable computing device.

6. The antenna of claim 1, wherein said measurement device comprises a signal processing device which operates to average the amplitude of the output signal of said demodulation circuit.

7. The antenna of claim 6, wherein said signal processing device includes a low pass filter.

8. The antenna of claim 4, wherein said measurement device comprises a signal processing device which operates to average the amplitude of the output signal of said demodulation circuit.

9. The antenna of claim 8, wherein said signal processing device includes a low pass filter.

10. The antenna of claim 1, wherein both said elevation misalignment member and said azimuth misalignment member are adjustable between the first misalignment position and the second misalignment position without requiring performance of additional measurements.

11. The antenna of claim 10, wherein said elevation misalignment member and said azimuth misalignment members utilize one of a visual indication, a mechanical indication or a electrical indication to determine when said antenna is positioned in said first misalignment position or said second misalignment position.

12. The antenna of claim 1, wherein said antenna dish comprises a symmetric receiver pattern.

13. A method of pointing an antenna dish at a transmitter so as to optimize reception, said method comprising the steps of:

(a) varying the azimuth of said antenna dish a predetermined number of degrees in a first direction from a predetermined azimuth angle;

(b) measuring a first signal strength of an incoming signal received by said antenna dish;

(c) varying the azimuth of said antenna dish the same predetermined number of degrees in a second direction from said predetermined azimuth angle, said second direction being opposite to said first direction;

(d) measuring a second signal strength of said incoming signal received by said antenna dish; and (e) comparing said first signal strength to said second signal strength.

14. The method of claim 13, wherein if said first signal strength and said second signal strength are within a predefined tolerance, said antenna predetermined azimuth angle represents the optimal azimuth angle for said antenna dish.

15. The method of claim 13, wherein if said first signal strength does not equal said second signal strength with a predefined tolerance, said process further comprises the steps of:

(f) adjusting said predetermined azimuth angle; and (g) repeating steps (a)–(e).

16. The method of claim 13, further comprising, prior to step (a), the step of performing a coarse antenna dish pointing procedure so as to point the antenna dish at a desired transmitter so as to allow said antenna dish to receive a signal from said transmitter, said coarse antenna dish pointing procedure defining said predetermined azimuth angle.

17. The method of claim 13, wherein said antenna dish comprises a symmetric receiver pattern.

18. The method of claim 13, wherein said first signal strength and said second signal strength are measured utilizing one of the group consisting of a voltmeter, a current meter, and portable computing device.

19. The method of claim 13, wherein said first signal strength is measured by averaging the amplitude of the incoming signal, and said second signal strength is measured by averaging the amplitude of the incoming signal.

20. The method of claim 19, wherein said measurement of said first signal strength and said second signal strength is performed utilizing a device including a low pass filter.

21. A method of pointing an antenna dish at a transmitter so as to optimize reception, said method comprising the steps of:

(a) varying the azimuth of said antenna dish a predetermined number of degrees in a first direction from a predetermined azimuth angle;

(b) measuring a first signal strength of an incoming signal received by said antenna dish;

(c) varying the azimuth of said antenna dish the same predetermined number of degrees in a second direction from said predetermined azimuth angle, said second direction being opposite to said first direction;

(d) measuring a second signal strength of said incoming signal received by said antenna dish; and (e) comparing said first signal strength to said second signal strength, wherein if said first signal strength equals said second signal strength within a predefined tolerance, said antenna predetermined azimuth angle represents the optimal azimuth angle for said antenna dish and said process proceeds to step (h), and if said first signal strength does not equal said second signal strength within said predefined tolerance, said process further comprises the steps of:

(f) adjusting said predetermined azimuth angle;

(g) repeating steps (a)–(e);

(h) varying the elevation of said antenna dish a predetermined number of degrees in a first direction from a predetermined elevation angle;

(i) measuring a third signal strength of an incoming signal received by said antenna dish;

(j) varying the elevation of said antenna dish the same predetermined number of degrees in a second direction from said predetermined elevation angle, said second direction being opposite to said first direction;

(k) measuring a fourth signal strength of said incoming signal received by said antenna dish; and (l) comparing said third signal strength to said fourth signal strength, wherein if said third signal strength equals said fourth signal strength within a predefined tolerance, said antenna predetermined elevation angle represents the optimal elevation angle for said antenna dish, and if said third signal strength does not equal said fourth signal strength with said predefined tolerance, said process further comprises the steps of:

(m) adjusting said predetermined elevation angle; and (n) repeating steps (h)–(l).

22. The method of claim 21, wherein said variation of said azimuth of said antenna dish is performed by an azimuth misalignment member which automatically adjusts said azimuth between a first misalignment position and a second misalignment position without requiring performance of additional measurements.

23. The method of claim 21, wherein said variation of said elevation of said antenna dish is performed by an elevation misalignment member which automatically adjusts said elevation between a first misalignment position and a second misalignment position without requiring performance of additional measurements.

24. The method of claim 21, further comprising, prior to step (a), the step of performing a coarse antenna dish pointing procedure so as to point the antenna dish at a desired transmitter so as to allow said antenna dish to receive a signal from said transmitter, said coarse antenna dish pointing procedure defining said predetermined elevation angle and said predetermined azimuth angle.

25. A method of pointing an antenna dish at a transmitter so as to optimize reception, said method comprising the steps of:

varying an azimuth angle of said antenna dish utilizing an azimuth misalignment member coupled to said antenna dish, said azimuth misalignment member capable of precisely setting the azimuth angle in a first misalignment position and a second misalignment position, said first misalignment position and said second misalignment position representing the same degree of change of azimuth from a set azimuth angle, said first misalignment position and said second misalignment position being in opposite directions from said set azimuth angle; and varying an elevation angle of said antenna dish utilizing an elevation misalignment member coupled to said antenna dish, said elevation misalignment member capable of precisely setting the elevation angle in a first misalignment position and a second misalignment position, said first misalignment position and said second misalignment position representing the same degree of change of elevation from a set elevation angle, said first misalignment position and said second misalignment position being in opposite directions from said set elevation angle.

26. The method according to claim 25, wherein both said elevation misalignment member and said azimuth misalignment member are automatically adjustable between the first misalignment position and the second misalignment position without requiring performance of additional measurements.

27. The method according to claim 25, further comprising the steps of:

measuring the strength of an incoming signal transmitted by said transmitter and received by said antenna dish when the antenna dish has an elevation angle corresponding to said first misalignment position so as to obtain a first signal strength and when said antenna dish has an elevation angle corresponding to said second misalignment position so as to obtain a second signal strength; and comparing said first signal strength to said second signal strength.

28. The method according to claim 25, further comprising the steps of:

measuring the strength of an incoming signal transmitted by said transmitter and received by said antenna dish when the antenna dish has an azimuth angle corresponding to said first misalignment position so as to obtain a third signal strength and when said antenna dish has an azimuth angle corresponding to said second misalignment position so as to obtain a fourth signal strength; and comparing said third signal strength to said fourth signal strength.

29. An antenna comprising:

an antenna dish; and a misalignment member coupled to said antenna dish and operative for varying an alignment angle of said antenna dish, said misalignment member capable of precisely setting the alignment angle in a first misalignment position and a second misalignment position, said first misalignment position and said second misalignment position representing the same degree of change of alignment from a set angle, said first misalignment position and said second misalignment position being in opposite directions from said set angle.

30. A method of pointing an antenna dish at a transmitter so as to optimize reception, said method comprising the steps of:

(a) varying the position of said antenna dish along a given axis a predetermined number of degrees in a first direction from a set angle;

(b) measuring a first signal strength of an incoming signal received by said antenna dish;

(c) varying the position of said antenna dish along said given axis the same predetermined number of degrees in a second direction from said set angle, said second direction being opposite to said first direction;

(d) measuring a second signal strength of said incoming signal received by said antenna dish; and (e) comparing said first signal strength to said second signal strength.

31. The method of claim 30, wherein said given axis corresponds to an orbital arc of a satellite.

32. The method of claim 30, wherein if said first signal strength equals said second signal strength with a predefined tolerance, said antenna position represents the optimal angle for said antenna dish for receiving a signal from said transmitter.

* * * * *